US010192477B2

(12) United States Patent
Chan et al.

(10) Patent No.: US 10,192,477 B2
(45) Date of Patent: Jan. 29, 2019

(54) PIXEL COMBINATION OF FULL COLOR LED AND WHITE LED FOR USE IN LED VIDEO DISPLAYS AND SIGNAGES

(71) Applicants: Lighthouse Technologies Limited, Shatin (HK); Lighthouse Technologies (Huizhou) Limited, Huizhou (CN)

(72) Inventors: Kui Lai Curie Chan, Hong Kong (CN); Shinsaku Kikkawa, Kawasaki (JP)

(73) Assignees: Lighthouse Technologies Limited, Shatin (HK); Lighthouse Technologies (Huizhou) Limited, Huizhou (CN)

( * ) Notice: Subject to any disclaimer, the term of this patent is extended or adjusted under 35 U.S.C. 154(b) by 720 days.

(21) Appl. No.: 14/592,544

(22) Filed: Jan. 8, 2015

(65) Prior Publication Data

US 2016/0203757 A1 Jul. 14, 2016

(51) Int. Cl.
*G09G 3/32* (2016.01)
*G09G 3/20* (2006.01)

(52) U.S. Cl.
CPC ..... *G09G 3/32* (2013.01); *G09G 3/2003* (2013.01); *G09G 2300/0452* (2013.01); *G09G 2310/08* (2013.01); *G09G 2340/06* (2013.01)

(58) Field of Classification Search
CPC ..... G09G 3/22; G09G 3/3208; G09G 3/30; G09G 3/3225; G09G 3/3233;
(Continued)

(56) References Cited

U.S. PATENT DOCUMENTS 5,113,258 A * 5/1992 Roth ..... H04N 5/21 348/607
8,737,736 B2 * 5/2014 Liu ..... G06T 5/50 382/169

(Continued)

FOREIGN PATENT DOCUMENTS

CN 101416100 A 4/2009
CN 103295485 A 9/2013

(Continued)

OTHER PUBLICATIONS

Search Report dated Apr. 24, 2015 for European Patent Application No. 15151536.8.

(Continued)

*Primary Examiner* — William Lu
(74) *Attorney, Agent, or Firm* — Duane Morris LLP

(57) ABSTRACT

A signal processing device and method for driving one or more light emitting diodes ("LEDs") of a video screen, display panel, module or other component. The signal processing device and method can control one or more RGB LEDs and/or white LEDs to produce light with increased uniformity and brightness at a reduced cost and having reduced power consumption. The signal processing device and method can generate a matrix brightness value based on one or more input LED driving signals; generate a complementary brightness value based on the one or more input LED driving signals; generate an LED driving signal based on the matrix brightness value and complementary brightness value; and delaying the one or more input LED driving signals generate one or more delayed LED driving signals.

16 Claims, 4 Drawing Sheets

(58) Field of Classification Search
CPC .. G09G 3/3241; G09G 3/3266; G09G 3/3275; G09G 3/3258
See application file for complete search history.

(56) References Cited

U.S. PATENT DOCUMENTS 9,161,058 B2 * 10/2015 Kim ..... H04N 19/105
2006/0221047 A1 * 10/2006 Tanizoe ..... G09G 3/3406 345/102
2007/0171218 A1 * 7/2007 Hong ..... G09G 3/3406 345/211
2008/0036797 A1 * 2/2008 Whang ..... G09G 3/006 345/698
2008/0150850 A1 * 6/2008 Park ..... G09G 3/2003 345/83
2008/0152219 A1 * 6/2008 Ramanath ..... G09G 5/02 382/162
2009/0009664 A1 * 1/2009 Kawashima ..... G09G 3/2003 348/655
2009/0167639 A1 * 7/2009 Casner ..... G02B 27/2214 345/58
2010/0033494 A1 * 2/2010 Klompenhouwer .... G06T 5/004 345/590
2011/0006973 A1 * 1/2011 Lin ..... G09G 3/32 345/83
2011/0074806 A1 * 3/2011 Chen ..... G09G 3/20 345/589
2011/0199395 A1 * 8/2011 Nathan ..... G09G 3/3241 345/690
2014/0071189 A1 * 3/2014 Park ..... G09G 5/02 345/694
2014/0085170 A1 * 3/2014 Park ..... G09G 5/02 345/83
2014/0176617 A1 * 6/2014 Jeong ..... G09G 3/2003 345/690
2014/0176623 A1 * 6/2014 Inoue ..... G09G 3/2003 345/690
2015/0154937 A1 * 6/2015 Funatsu ..... G09G 5/02 345/593

FOREIGN PATENT DOCUMENTS

CN 103839512 A 6/2014
CN 104240636 A 12/2014
EP 2750124 A2 7/2014

OTHER PUBLICATIONS

Search Report dated Feb. 4, 2015 for Chinese Patent Application No. 201510051616.6 (with English translation).
Apr. 5, 2017 Communication Pursuant to Article 94(3) EPC concerning European Patent Application No. 15151536.8.

* cited by examiner

PIXEL COMBINATION OF FULL COLOR LED AND WHITE LED FOR USE IN LED VIDEO DISPLAYS AND SIGNAGES

BACKGROUND

Field

The present disclosure relates to lighting, devices and methods. In particular, the present disclosure relates to method and system for pixel combinations of color and white lighting devices for a video display screen.

Related Art

Video displays can use light emitting diodes ("LEDs") because of the brightness and low power requirements of the LEDs. LED video screens can be used in, for example, digital billboards to display, for example, advertisements, textual and/or graphical informational messages, and live or prerecorded videos. LED video screens, also referred to as LED display walls, are made up of one or more individual panels and/or intelligent modules ("IM") having a predetermined number and arrangement of controllable LEDs. The panels and/or modules are mounted net to each other and their outputs are controlled such that they appear to be one large display screen.

The LEDs used in the LED video screen, etc. are usually red, green end/or blue ("RGB") LEDs whose output can be controlled such that the RGB components mix according to known principles to create any visible color (including black and white).

However, when an RGB LED is configured to emit white, light, each of the red, green, and blue LEDs of the RGB LED are require to emit their respective colors to produce white light, which increases the driving current of the RGB LED. Further, RGB LEDs used for modules, panels, etc. may have different wavelengths of color due to, for example, their composition, manufacturing variations, and/or other differences. As a result, LEDs on the individual panels and modules may have different output coloring from panel to panel and module to module. These variations can cause RGB LEDs configured to emit white light to also emit one or more tertiary and/or secondary colors. Further, the individual colors of the RGB LEDs can be distinguished from each other at close distances. Since panels comprise multiple RGB LEDs and video screens comprise multiple panels and/or modules placed next to each other, uniformity of the screen's output will be affected by the color differences between the LED batches. Further, the cost of RGB LEDs is greater than the cost of white LEDs. Therefore, panels including RGB LEDs that are configured to emit white light are more expensive than panels included white LEDs.

Accordingly, there exists a need to provide an improved LED panel that can produce white light with increased uniformity and brightness at a reduced cost and having reduced power consumption.

BRIEF SUMMARY

In consideration of the above problems, in accordance with one aspect disclosed herein, a signal processing device is provided. In an exemplary embodiment, the signal processing device includes a matrix calculation device configured to generate a matrix brightness value based on one or more input light emitting diode ("LED") driving signals; a minimum calculation device configured to generate a complementary brightness value based on the one or more input LED driving signals; and an adder configured to generate an LED driving signal based on the matrix brightness value and the complementary brightness value. In an exemplary embodiment, the signal processing device can also include a delay device configured to delay the one or more input. LED driving signals to generate one or more delayed LED driving signals. In an exemplary embodiment, the LED driving signal generated by the adder is a white LED driving signal.

In an exemplary embodiment, the signal processing device includes a first multiplier configured to multiple the matrix brightness value by an adjustment factor to generate an adjusted matrix brightness value; and a second multiplier configured to multiple the complementary brightness value by a difference of one and the adjustment factor to generate an adjusted matrix brightness value. In this example, the adder can be configured to generate the LED driving signal based on the adjusted matrix brightness value and the adjusted complementary brightness value.

In an exemplary embodiment, the input LED driving signal(s) include a red input LED driving signal configured to drive a red-green-blue ("RGB") LED of the light emitting panel; a green input LED driving signal configured to chive the RGB LED of the light emitting panel; and a blue input LED driving signal configured to drive the RGB LED of the light emitting panel.

In an exemplary embodiment, the minimum calculation device can be configured to determine a color represented by the one or more input LED driving signals. In this example, the minimum calculation device can be configured to generate the complementary brightness value based on the color determination. The minimum calculation device can be configured to generate the complementary brightness value to have a minimum or substantially minimum value in response to the minimum calculation device determining that the one or more input LED driving signals represent a primary or a secondary color. The minimum calculation device can be configured to generate the complementary brightness value to have a maximum or substantially maximum value in response to the minimum calculation device determining that the one or more input LED driving signals represent a tertiary color.

In an exemplary embodiment, the signal processing device is configured to drive a light emitting panel that includes white LEDs and RGB LEDs arranged in rows and columns such that each of the white LEDs and each of the RGB LEDs alternate in each of the rows and in each of the columns.

In an exemplary embodiment, a video processing method is provided. The video processing method can include: generating a matrix brightness value based on one or more input LED driving signals; generating a complementary brightness value based on the one or more input LED driving signals; generating an LED driving signal based on the matrix brightness value and the complementary brightness value; delaying the one or more input LED driving signals to generate one or more delayed LED driving signals; multiplying the matrix brightness value by an adjustment factor to generate an adjusted matrix brightness value; multiplying the complementary brightness value by a difference of one and the adjustment factor to generate an adjusted matrix brightness value.

In an exemplary embodiment, the generating of the LED driving signal is based on the adjusted matrix brightness value and the adjusted complementary brightness value. In an exemplary embodiment, the generating of the complementary brightness value includes determining a color represented by the one or more input LED driving signals; and generating the complementary brightness value based on the color determination. In an exemplary embodiment, the generating of the complementary brightness value includes generating the complementary brightness value to have a minimum or substantially minimum value in response to determining that the color represented by the one or more input LED driving signals is a primary or a secondary color. In an exemplary embodiment, the generating of the complementary brightness value includes generating the complementary brightness value to have a maximum or substantially maximum value in response to determining that the color represented by the one or more input LED driving signals is a tertiary color.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments. The figures are for illustration purposes only and are not necessarily drawn to scale. The present disclosure itself, however, may best be understood by reference to the detailed description which follows when taken in conjunction with the accompanying drawings in which.

The embodiments of the present disclosure will be described with reference to the accompanying drawings. The drawing in which an element first appears is typically indicated by the leftmost digit(s) in the corresponding reference number.

DETAILED DESCRIPTION

In the following description, numerous specific details are set forth in order to provide, a thorough understanding of the embodiments of the present disclosure. However, it will be apparent to those skilled in the aft that the embodiments, including structures, systems, and methods, may be practiced without these specific details. The description and representation herein are the common means used by those experienced, or skilled in the art to most effectively convey the substance of their work to others skilled in the art. In other instances, well-known methods, procedures components, and circuitry have not been described in detail to avoid unnecessarily obscuring aspects of the disclosure.

For the purposes of this discussion, the term "processor circuitry" shall be understood to be one or more: circuit(s), processor(s), or a combination thereof. For example, a circuit can include an analog circuit, at digital circuit, state machine logic, other structural electronic hardware, or a combination thereof. A processor can include a microprocessor, a digital signal processor (DSP), or other hardware processor. The processor can be "hard-coded" with instructions to perform corresponding inaction(s) according to embodiments described herein. Alternatively, the processor(s) can access an internal and/or external memory to retrieve instructions stored in the memory, which when executed by the processor(s), perform the corresponding function(s) associated with the processor(s).

Figure 1:
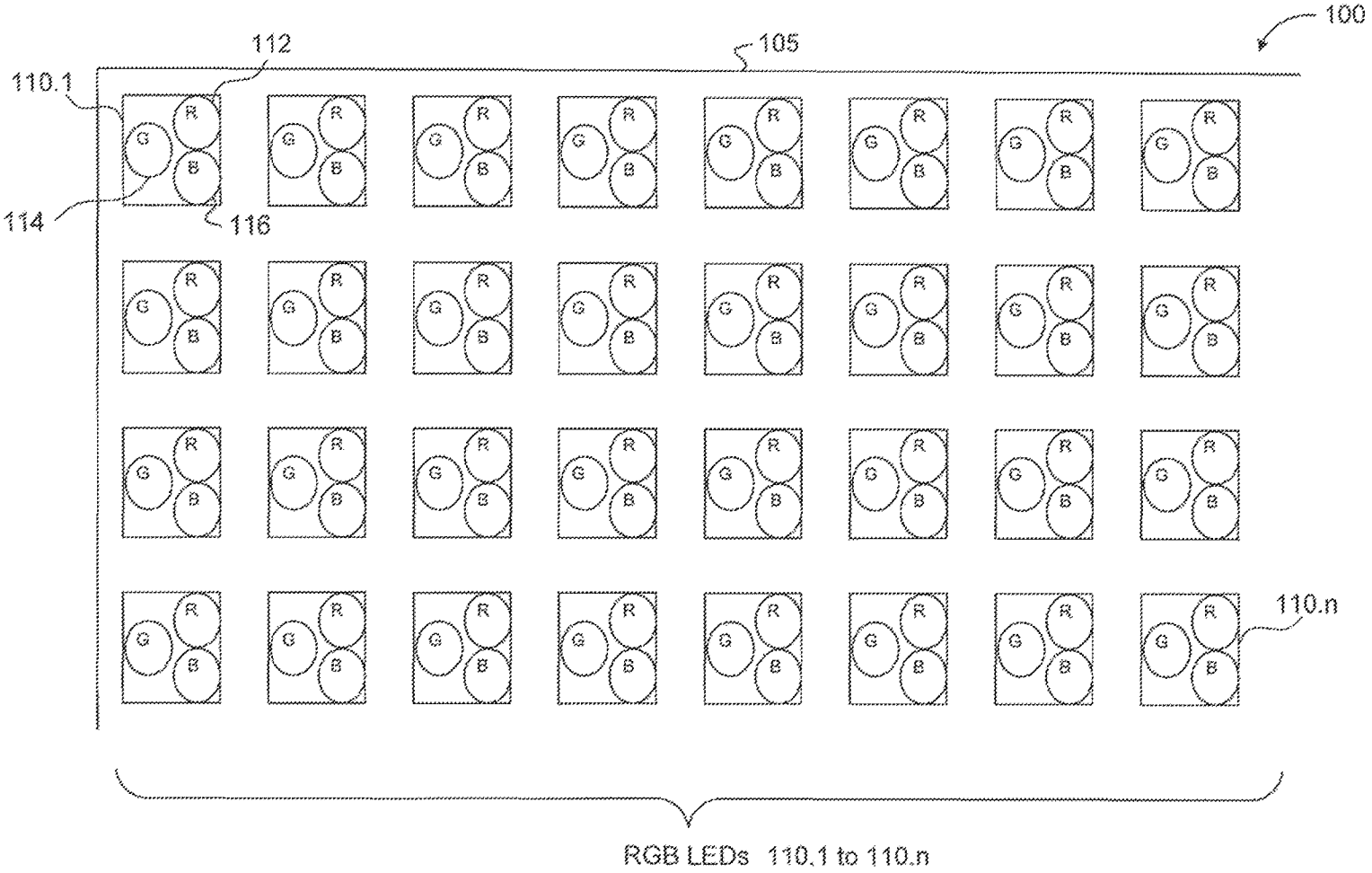
FIG. 1 illustrates an LED panel according to an exemplary embodiment of the present disclosure.

FIG. 1 illustrates an LED panel 100 comprised of RGB LEDs 110.1 to **110.*n* according to an exemplary embodiment of the present disclosure. As discussed above, each of the RGB LEDs 110 include one or more red LEDs 112, one or more green LEDs 114, and one or more blue LEDs 116. The outputs of the red LED(s) 112, green LED(s) 114, and blue LED(s) 116** can be controlled such that the respective red, green, and blue components mix according to known principles to create any visible color (including black and white).

The LED panel 100 can include a printed circuit board (PCB) 105 in which RGB LEDs 110 are disposed thereon and configured to be electrically connected to one or more power sources and/or LED driving circuitry (not shown). For example, the power source(s) and/or LED driving circuitry can be disposed on the PCB 105 and electrically connected to the RGB LEDs 110 is one or more electrical connections on, and/or within, the PCB 105. Alternatively, the power source(s) and/or LED driving circuitry can be externally located with respect to the PCB 105 on, for example, another PCB that is electrically connected to the PCB 105.

FIG. 9 illustrates an LED panel 200 according to an exemplary embodiment of the present disclosure. In an exemplary embodiment, the LED panel 200 includes RGB LEDs 210.1 to **210.*m* and white LEDs 220.1 to 220.*n*. In an exemplary embodiment, LED panel 200 includes equal numbers of RGB LEDs and white LEDs (i.e., m=n). However, the LED panel 200 is not limited to configurations having equal numbers of RGB LEDs 210 and white LEDs 220, and the LED panel 200 can include different number of RGB LEDs 210 and white LEDs 220** as would be understood by one of ordinary skill in the relevant art(s) without departing tram the spirit can scope of the present disclosure.

LED panel 200 can include a printed circuit board (PCB) 205 in which RGB LEDs 210 and white LEDs 220 are disposed thereon and configured to be electrically connected to one or more power sources and/or LED driving circuitry (not shown). In an exemplary embodiment, the LED panel can be electrically connected to a signal processing device configured to control the outputs of the RGB LEDs 210 and white LEDs 220. For example, the LED panel 200 (including the RGB LEDs 210 and white LEDs 220) can be electrically connected to, and controlled by signal processing device 300 illustrated in FIG. 3 and discussed in detail below.

In an exemplary embodiment, each of the RGB LEDs 210 include one or more red LEDs 212, one or more green LEDs 214, and one or more blue LEDs 216. The white LEDs 220 can include one or more white LEDs 222 configured to emit white light. In exemplary embodiments, the outputs of the RGB LEDs 210 (including the output of their respective red LED(s) 112, green LED(s) 114, and blue LED(s) 116), and/or the outputs of the white LEDs 220 (including the output of their respective white LEDs 222) can be controlled to produce white light. This white light produced by the LED panel 200 can be produced with increased uniformity and brightness at a reduced cost and having reduced power consumption. The LED panel 200 is not limited to producing white light and can be configured to produce one or more other light colors as would be understood by one or ordinary skill in the relevant art(s) without departing from the sprit and scope of the present disclosure.

In an exemplary embodiment, the RGB LEDs 210 and the white LEDs 220 of the LED panel 200 are arranged such that each of the rows and each of the columns of the LED panel 200 include alternating RGB LEDs 210 and white LEDs 220. For example, not considering RGB LEDs 210 and white LEDs 220 located on a boundary of LED panel 200, each RGB LED 210 of the LED panel 200 can be surrounded by eight LEDs—four white LEDs 220 located at, for example, 0°, 90°, 180°, and 360°, and four RGB LEDs 210 located at, for example, 45°, 135°, 225°, and 315°. Similarly, each white LED 220 of the LED panel 200 can be surrounded by eight LEDs—four RGB LEDs 210 located at, for example, 0°, 90°, 180°, and 360°, and four white LEDs 220 located at, for example, 45°, 135°, 225°, and 315°. In this example, the boundary LEDs can have surrounding LEDs similarly arranged on the sides of the boundary LEDs where such surrounding LEDs fall within the LED panel 200. The arrangement of RGB LEDs 210 and white LEDs 220 are not limited to this exemplary embodiment, and the RGB LEDs 210 and white LEDs 220 can be arranged in one or more other arrangements, including, for example, alternating rows/columns of RGB LEDs 210 with rows/columns of white LEDs 210, and/or one or more other arrangements as would be understood by one of ordinary skill in the relevant art(s).

Figure 3:
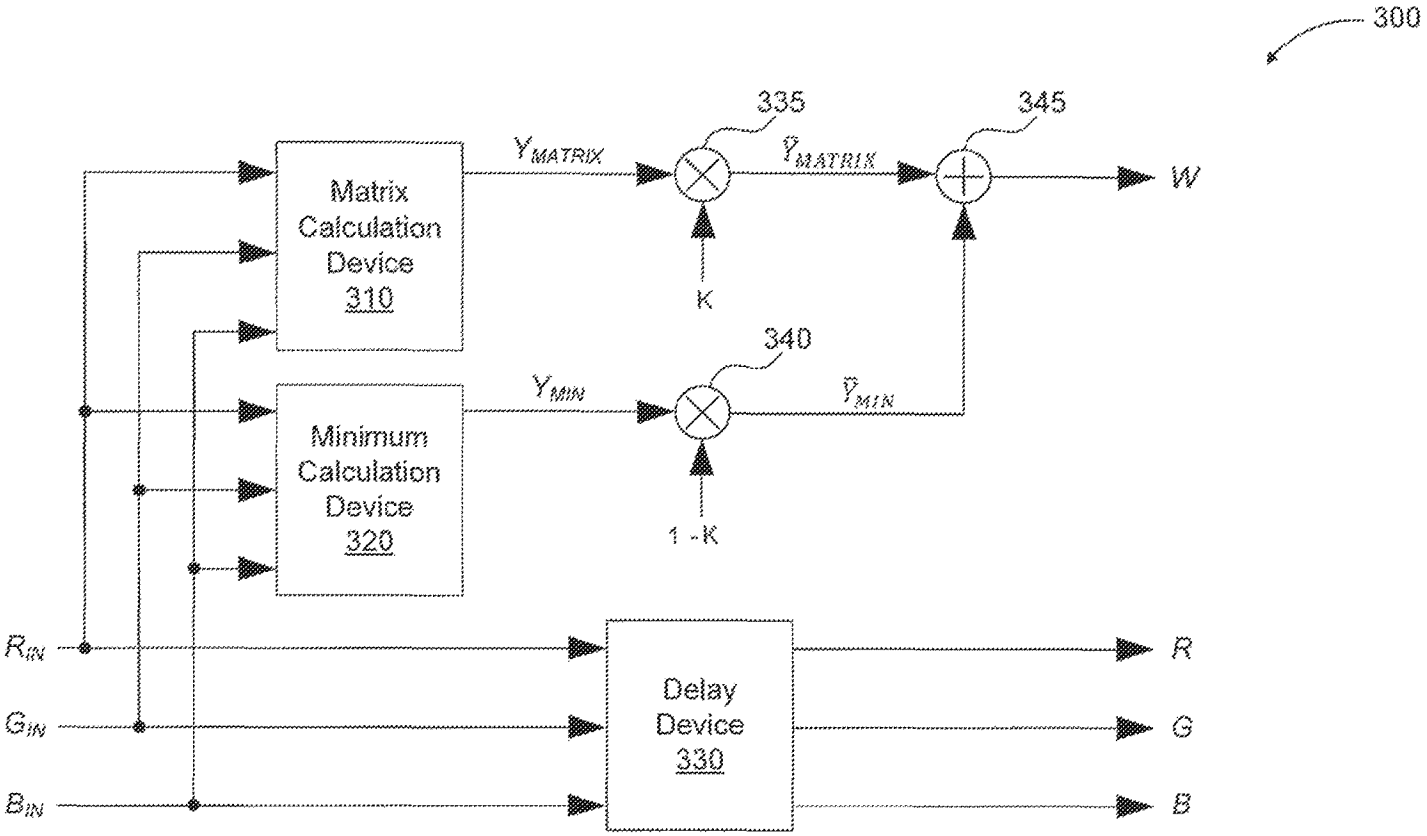
FIG. 3 illustrates a signal processing device according to an exemplary embodiment of the present disclosure.

FIG. 3 illustrates a signal processing device 300 according to an exemplary embodiment of the present disclosure. The signal processing device 300 can include processor circuitry configured to generate a white LED driving signal W and RGB LED driving signals R, G, and B based on input RGB LED driving signals $R_{IN}$, $G_{IN}$, and $B_{IN}$ to drive one or more of the RGB LEDs (e.g., RGB LEDs 210) and/or one or more white LEDs (e.g., white LEDs 220). In an exemplary embodiment, the signal processing device 300 includes matrix calculation device 310, minimum calculation device 320, delay device 330, multiplier 335, multiplier 340, and adder 345.

In an exemplary embodiment, the matrix calculation device 310 includes one or more processors, circuitry, and/or logic that are configured to generate a matrix brightness value $Y_{MATRIX}$ based on one or more LED driving signals. For example, the matrix calculation device 310 can be configured to generate a matrix brightness value $Y_{MATRIX}$ based on RGB LED driving signals $R_{IN}$, $G_{IN}$, and $B_{IN}$ generated by, for example, RGB LED driving circuitry (not shown). In this example, the matrix calculation device 310 converts corresponding RGB driving signals for driving all RGB LED to a signal configured to drive a white LED.

In an exemplary embodiment, the minimum calculation device 320 includes one or more processors, circuitry, and/or logic that are configured to generate a complementary brightness value $Y_{MIN}$ based on one or more LED driving signals. For example, the minimum calculation device 320 can be configured to generate a complementary brightness value $Y_{MIN}$ based on RGB LED driving signals $R_{IN}$, $G_{IN}$, and $B_{IN}$ generated by, for example, the RGB LED driving circuitry (not shown). In this example, the minimum calculation device 320 converts corresponding RGB driving signals for driving an RGB LED to a commentary signal configured to drive a white LED. In an exemplary embodiment, the minimum calculation device 320 can be configured to determine one or more colors represented by RGB LED driving signals $R_{IN}$, $G_{IN}$, and $B_{IN}$, and to generate the complementary brightness value based on determined color(s).

In an exemplary embodiment, the minimum calculation device 320 can be configured to generate a complementary brightness value $Y_{MIN}$ having a value of zero or substantially zero when the input RGB LED driving signals $R_{IN}$, $G_{IN}$, and $B_{IN}$ collectively correspond to, for example, a primary color (e.g., red, green, or blue), or when the input RGB LED driving signals $R_{IN}$, $G_{IN}$, and $B_{IN}$ collectively correspond to, for example, a secondary color yellow, magenta, or cyan). In an exemplary embodiment, the minimum calculation device 320 can be configured to generate an increased complementary brightness value $Y_{MIN}$ when the input RGB LED driving signals $R_{IN}$, $G_{IN}$, and $B_{IN}$ collectively correspond to, for example, a tertiary color (e.g., orange, chartreuse green, spring green, azure, violet, rose). That is, in operation, the minimum calculation device 320 can generate a complementary brightness value $Y_{MIN}$ to complement the matrix brightness value $Y_{MATRIX}$ generated by the matrix calculation device 310 for tertiary colors, but does not generate a complementary brightness value $Y_{MIN}$ that complements (or generates a signal that minimally complements) the matrix brightness value $Y_{MATRIX}$ for primary and/or secondary colors.

In an exemplary embodiment, the minimum calculation device 320 can be configured to generate a complementary brightness value $Y_{MIN}$ having a minimum or substantially minimum value for input RGB LED driving signals $R_{IN}$, $G_{IN}$, and $B_{IN}$ collectively corresponding to primary or secondary colors, and generate a complementary brightness value having a maximum or substantially maximum value for input RGB LED driving signals $R_{IN}$, $G_{IN}$, and $B_{IN}$ collectively corresponding to a tertiary color.

In these examples, a tertiary color can be defined as, for example, a color made by mixing as primary color with a secondary color, a color made by mixing two secondary colors, and/or a color made by mixing full saturation of a first primary color with half saturation of a second primary color and zero saturation of a third primary color.

The multiplier 335 and the multiplier 340 can each include one or more processors, circuitry, and/or logic that are configured to multiply two or more inputs together to generate a multiplied output. The adder 345 includes one or more processors, circuitry, and/or logic that are configured to add two or more inputs together to generate a summed output.

In an exemplary embodiment, the multiplier 335 can be configured to multiply the matrix brightness value $Y_{MATRIX}$ generated by the matrix calculation device 310 with an adjustment factor to generate an adjusted matrix brightness value $\overline{Y}_{MATRIX}$. The multiplier 340 can be configured to multiply the complementary brightness value $Y_{MIN}$ generated by the minimum calculation device 320 with the difference of 1−K to generate an adjusted complementary brightness value $\overline{Y}_{MIN}$. In an exemplary embodiment, the adjustment factor K has a value $0 \leq K \leq 1$. In operation, the adjustment factor K can be set to reduce color fading and/or dot roughness. The adder 345 can be configured to add the adjusted matrix brightness value $\overline{Y}_{MATRIX}$ with the adjusted complementary brightness value $\overline{Y}_{MIN}$ to generate a white LED driving signal W.

In an exemplary embodiment, the white LED driving signal W can be represented as follows:

$$W=(Y_{MATRIX}\times K)+(Y_{MIN}\times(1-K)) \quad \text{(Equation 1)}$$

where K is an adjustment factor having a value of $0 \leq K \leq 1$, $Y_{MATRIX}$ is a matrix brightness value, and $Y_{MIN}$ is a complementary brightness value.

The delay device 330 includes one or more processors, circuitry, and/or logic that are configured to receive one or more input signals and to delay the intuit signal(s) by a predetermined time value and/or an adaptively updated time value. In an exemplary embodiment, the delay device 330 can be configured to receive input RGB LED driving signals $R_{IN}$, $G_{IN}$, and $B_{IN}$, delay the input RGB LED driving signals $R_{IN}$, $G_{IN}$, and $B_{IN}$ by a time delay λ, and to generate RGB LED driving signals R, G, and B. In an exemplary embodiment, the value of the time delay λ can be set and/or calibrated to correspond to the total time delay introduced on the input RGB LED driving signals $R_{IN}$, $G_{IN}$, and $B_{IN}$ by the matrix calculation device 310, minimum calculation device 320, multiplier 335, multiplier 340, and adder 345.

Figure 2:
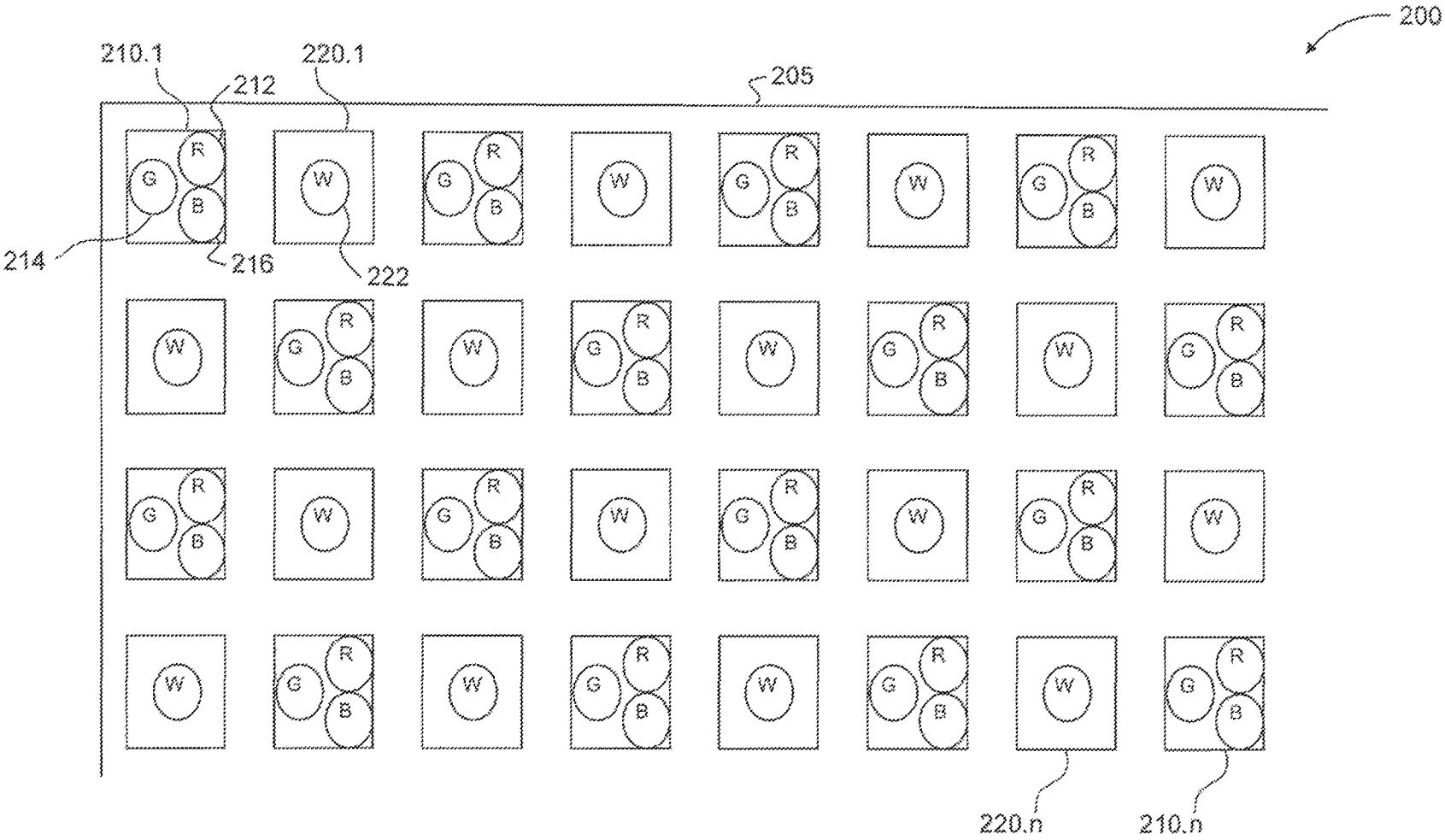
FIG. 2 illustrates an LED panel according to an exemplary embodiment of the present disclosure.

In an exemplary embodiment, the signal processing device 300 can be configured to generate a white LED driving signal W, and RGB LED driving signals B, G, and B based on the RGB LED driving signals $R_{IN}$, $G_{IN}$, and $B_{IN}$ to drive one or more of the RGB LEDs 210 and one or more white LEDs 220 of the LED panel 200 of FIG. 2.

Figure 4:
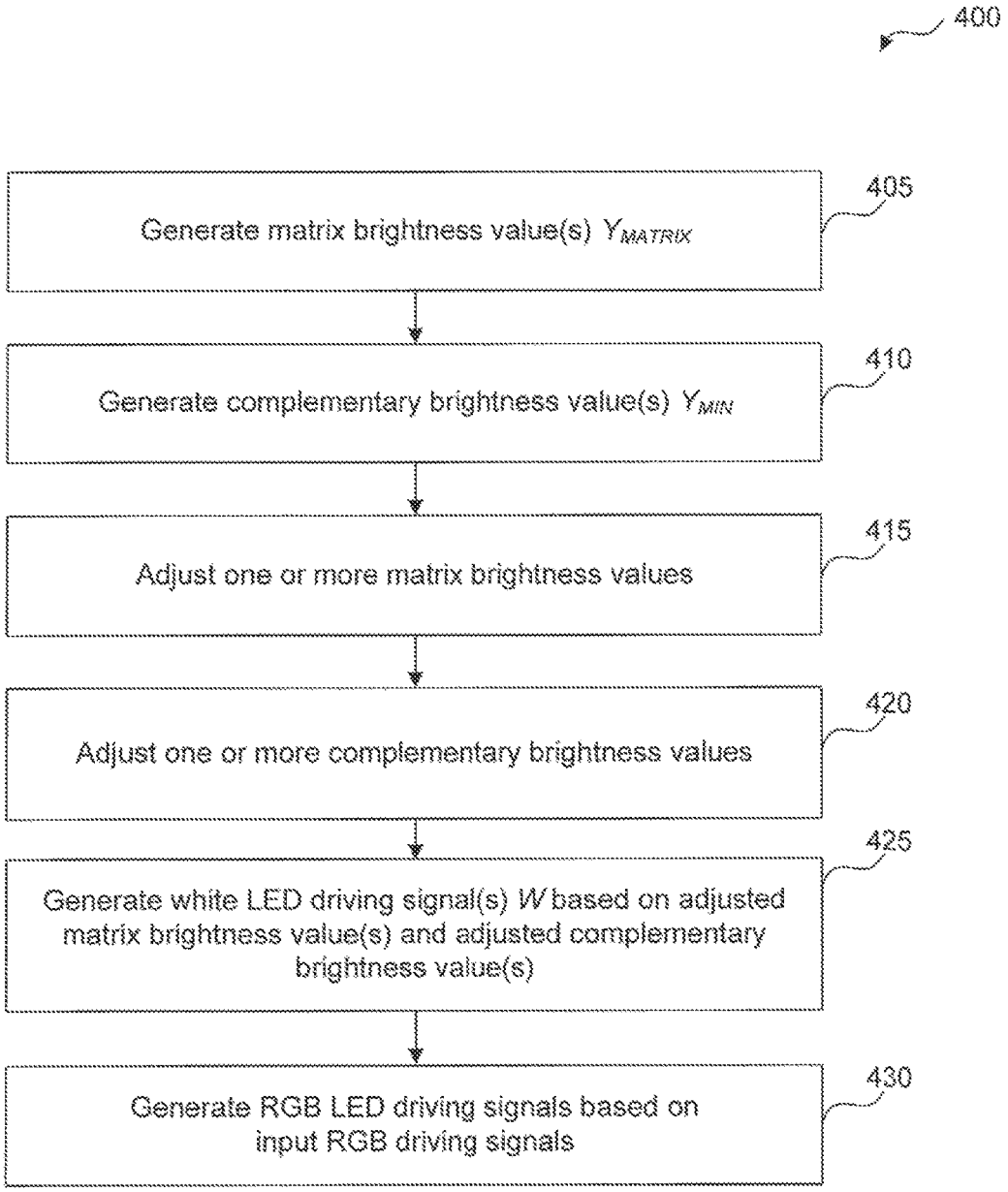
FIG. 4 illustrates a signal processing method according to an exemplary embodiment of the present disclosure.

FIG. 4 illustrates a flowchart 400 of a signal processing method according to an exemplary embodiment of the present disclosure. The method of flowchart 400 is described with continued reference to one or more of FIGS. 1-3. The steps of the method of flowchart 400 are not limited to the order described below, and the various steps may be performed in a different order. Further, two or more steps of the method of flowchart 400 may be performed simultaneously with each other.

The method of flowchart 400 begins at step 405, where one or more matrix brightness value $Y_{MATRIX}$ are generated based on input RGB LED driving signals $R_{IN}$, $G_{IN}$, and $B_{IN}$. In an exemplary embodiment the matrix calculation device 310 can be configured to generate one or more matrix brightness value $Y_{MATRIX}$ based on input RGB LED driving signals $R_{IN}$, $G_{IN}$, and $B_{IN}$ received from, for example, one or more LED drivers.

After step 405, the method of flowchart 400 transitions to step 410, where one or more complementary brightness value $Y_{MIN}$ are generated based on input RGB LED driving signals $R_{IN}$, $G_{IN}$, and $B_{IN}$. In an exemplary embodiment, the minimum calculation device 320 can be configured to generate one or more complementary brightness value $Y_{MIN}$ based on input RGB LED driving signals $R_{IN}$, $G_{IN}$, and $B_{IN}$ received from, for example, one or more LED drivers. In an exemplary embodiment, the minimum calculation device 320 can be configured to generate one or more complementary brightness value $Y_{MIN}$ based on whether the input RGB LED driving signals $R_{IN}$, $G_{IN}$, and $B_{IN}$ collectively correspond to a primary or secondary color, and/or based on whether the input RGB LED driving signals $R_{IN}$, $G_{IN}$, and $B_{IN}$ collectively correspond to a tertiary color.

After step 410, the method of flowchart 400 transitions to step 415, where the matrix brightness value(s) $Y_{MATRIX}$ are adjusted to generate one or more adjusted matrix brightness values $\bar{Y}_{MATRIX}$. In an exemplary embodiment, the multiplier 335 can be configured to multiply the matrix brightness value(s) $Y_{MATRIX}$ generated by the matrix calculation device 310 with an adjustment factor K to generate the adjusted matrix brightness value(s) $\bar{Y}_{MATRIX}$.

After step 415, the method of flowchart 400 transitions to step 420, where the complementary brightness value(s) $Y_{MIN}$ are adjusted to generate one or more adjusted complementary brightness value $\bar{Y}_{MIN}$. In an exemplary embodiment, multiplier 340 can be configured to multiply the complementary brightness value(s) $Y_{MIN}$ generated by the minimum calculation device 320 with the difference of 1−K to generate the adjusted complementary brightness value(s) $\bar{Y}_{MIN}$.

After step 420, the method of flowchart 400 transitions to step 425, where one or more white LED driving signal W are generated. In an exemplary embodiment, the adder 345 can be configured to add the adjusted matrix brightness value(s) $\bar{Y}_{MATRIX}$ with the adjusted complementary brightness value(s) $\bar{Y}_{MIN}$ to generate a white LED driving signal W.

After step 425, the method of flowchart 400 transitions to step 430, where RGB LED driving signals R, G, and B are generated based on the input RGB LED driving signals $R_{IN}$, $G_{IN}$, and $B_{IN}$. In an exemplary embodiment, the delay device 330 can be configured to delay the input RGB LED driving signals $R_{IN}$, $G_{IN}$, and $B_{IN}$ by a time delay to generate RGB LED driving signals R, G, and B. The generated RGB LED driving signals R, G, and B and white LED driving signal W can be provided, for example, LED panel 200 to drive one or more of the RGB LEDs 210 and/or one or more of the white LEDs 220.

CONCLUSION

The aforementioned description of the specific embodiments will so fully reveal the general nature of the disclosure that others can, be applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose at description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computing device). For example, a machine-readable medium may include read only memory (ROM); random access memory (RAM), magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

In embodiments having one or more components that include one or more processors, one or more of the processors can include (and/or be configured to access) one or more internal and/or external memories that store instructions and/or code that, when executed by the processor(s), cause the processor(s) to perform one or more functions and/or operations related to the operation of the corresponding component(s) as described herein and/or as would appreciated by those skilled in the relevant art(s).

The present disclosure has been described above with the aid of functional building blocks illustrating the implementation of specified functions and relationships thereof. The boundaries of these functional building blocks have been arbitrarily defined herein for the convenience of the description. Alternate boundaries may be defined so long as the specified functions and relationships thereof are appropriately performed.

What is claimed is:

1. A signal processing device configured to drive a light emitting panel, comprising:

a matrix calculation device configured to generate a matrix brightness value based on one or more input light emitting diode (LED) driving signals;

a minimum calculation device configured to generate a complementary brightness value based on the one or more input LED driving signals and the color associated with the one or more input LED driving signals;

an adder configured to generate an LED driving signal based on the matrix brightness value and the complementary brightness value; and wherein the minimum calculation device is further configured to generate the complementary brightness value to have a minimum or substantially minimum value in response to the minimum calculation device determining that the LED driving signals are converted into the matrix brightness value for a primary or a secondary color, and the minimum calculation device is further configured to generate the complementary brightness value to have a maximum or substantially maximum value in response to the minimum calculation device determining that the red, green, and blue LED driving signals are converted into the matrix brightness value for a tertiary color.

2. The signal processing device of claim 1, wherein the LED driving signal generated by the adder is a white LED driving signal.

3. The signal processing device of claim 1, further comprising:

a delay device configured to delay the one or more input LED driving signals to generate one or more delayed LED driving signals.

4. The signal processing device of claim 1, wherein the one or more input LED driving signals comprise:

a red input LED driving signal configured to drive a red-green-blue (RGB) LED of the light emitting panel;

a green input LED driving signal configured to drive the RGB LED of the light emitting panel; and a blue input LED driving signal configured to drive the RGB LED of the light emitting panel.

5. The signal processing device of claim 1, further comprising:

a first multiplier configured to multiply the matrix brightness value by an adjustment factor to generate an adjusted matrix brightness value; and a second multiplier configured to multiply the complementary brightness value by a difference of one and the adjustment factor to generate an adjusted matrix brightness value.

6. The signal processing device of claim 5, wherein the adder is configured to generate the LED driving signal based on the adjusted matrix brightness value and the adjusted complementary brightness value.

7. The signal processing device of claim 1, wherein the light emitting panel comprises white LEDs and red-green-blue (RGB), LEDs arranged in rows and columns such that each of the white LEDs and each of the RGB LEDs alternate in each of the rows and in each of the columns.

8. The signal processing device of claim 7, further comprising:

a delay device configured to delay the one or more input LED driving signals to generate one or more delayed LED driving signals, wherein the signal processing device is configured to drive one or more of the RGB LEDs based on the one or more delayed LED driving signals and to drive one or more of the white LEDs based on the LED driving signal generated by the adder.

9. A signal processing method for driving a light emitting panel, comprising:

generating a matrix brightness value based on one or more input light emitting diode (LED) driving signals;

generating a complementary brightness value based on the one or more input LED driving signals and the color associated with the one or more input LED driving signals; and generating an LED driving signal based on the matrix brightness value and the complementary brightness value; and wherein the complementary brightness value has a minimum or substantially minimum value when the generated LED driving signals are based on the matrix brightness value for a primary or a secondary color, and the complementary brightness value has a maximum or substantially maximum value when the generated LED driving signals are based on the matrix brightness value for a tertiary color.

10. The signal processing method of claim 9, wherein the LED driving signal is a white LED driving signal.

11. The signal processing method of claim 9, further comprising:

delaying the one or more input LED driving signals to generate one or more delayed LED driving signals.

12. The signal processing method of claim 9, wherein the one or more input LED driving signals comprise:

a red input LED driving signal configured to drive a red-green-blue (RGB) LED of the light emitting panel;

a green input LED driving signal configured to drive the RGB LED of the light emitting panel; and a blue input LED driving signal configured to drive the RGB LED of the light emitting panel.

13. The signal processing method of claim 9, further comprising:

multiplying the matrix brightness value by an adjustment factor to generate an adjusted matrix brightness value; and multiplying the complementary brightness value by a difference of one and the adjustment factor to generate an adjusted matrix brightness value.

14. The signal processing method of claim 13, wherein the generating the LED driving signal is based on the adjusted matrix brightness value and the adjusted complementary brightness value.

15. The signal processing method of claim 9, wherein the generating the complementary brightness value comprises:

determining a color represented by the one or more input LED driving signals; and generating the complementary brightness value based on the color determination.

16. A signal processing device configured to drive a light emitting panel, comprising:

a matrix calculation device configured to generate a matrix brightness value based on LED driving signals, comprising:

a red input LED driving signal configured to drive a RGB LED of the light emitting panel;

a green input LED driving signal configured to drive the RGB LED of the light emitting panel;

a blue input LED driving signal configured to drive the RGB LED of the light emitting panel;

a minimum calculation device configured to generate a complementary brightness value, wherein the complementary brightness value is generated when the matrix brightness value generated by the matrix calculation device corresponds to a tertiary color;

an adder configured to generate an LED driving signal based on the matrix brightness value and the complementary brightness value, wherein the LED driving signal generated by the adder is a white LED driving signal only; and a delay device configured to receive a red input LED driving signal, a green input LED driving signal, and a blue input LED driving signal, and output a delayed respective red, green, and blue driving signal based on a time delay in the white driving signal generated by the adder.

* * * * *